United States Patent [19]

Kloiber

[11] Patent Number: 4,695,818

[45] Date of Patent: Sep. 22, 1987

[54] ELECTRICAL RESISTOR WITH A NEGATIVE TEMPERATURE COEFFICIENT FOR INCREMENTAL RESISTANCE VALUES AND METHOD FOR MANUFACTURING SAME

[75] Inventor: Gerald Kloiber, Feldkirchen/Graz, Austria

[73] Assignee: Siemens Aktiengesellschaft, Berlin and Munich, Fed. Rep. of Germany

[21] Appl. No.: 829,622

[22] Filed: Feb. 14, 1986

[30] Foreign Application Priority Data

Mar. 7, 1985 [DE] Fed. Rep. of Germany ..... 3508163

[51] Int. Cl.[4] ..... H01C 7/10; H01C 1/144

[52] U.S. Cl. ..... 338/22 R; 338/272; 338/271; 338/329; 338/333; 338/22 SD; 338/332

[58] Field of Search ..... 338/272, 271, 254, 329, 338/332, 331, 22 R, 22 SD, 333

[56] References Cited

U.S. PATENT DOCUMENTS

| | | | |
|---|---|---|---|
| 2,606,955 | 8/1952 | Herrick | 175/41 |
| 2,674,583 | 4/1954 | Christensen | 338/22 R |
| 2,686,244 | 8/1954 | Dahm et al. | 201/63 |
| 3,676,211 | 7/1972 | Kourtesis et al. | 117/212 |
| 3,793,604 | 2/1974 | Duggan et al. | 338/22 R |

FOREIGN PATENT DOCUMENTS

| | | | |
|---|---|---|---|
| 1947799 | 4/1971 | Fed. Rep. of Germany . | |
| 2052489 | 5/1971 | Fed. Rep. of Germany . | |
| 2834348 | 2/1980 | Fed. Rep. of Germany . | |
| 2838508 | 3/1980 | Fed. Rep. of Germany . | |
| 271098 | 11/1927 | United Kingdom | 338/332 |

OTHER PUBLICATIONS

Siemens brochure, "Heissleiter Lieferprogramm 1985/1986".

*Primary Examiner*—E. A. Goldberg
*Assistant Examiner*—M. M. Lateef
*Attorney, Agent, or Firm*—Hill, Van Santen, Steadman & Simpson

[57] ABSTRACT

An electrical resistor having a negative temperature coefficient for incremental resistance values has a resistance wafer with solderable coatings on opposite sides thereof and current lead elements soldered to the coatings, with the soldered ends of the lead elements being each coiled to form an annular eye, the soldering covering only the region of the eye and leaving the remainder of the coatings outside of the eye free of solder.

5 Claims, 2 Drawing Figures

ELECTRICAL RESISTOR WITH A NEGATIVE TEMPERATURE COEFFICIENT FOR INCREMENTAL RESISTANCE VALUES AND METHOD FOR MANUFACTURING SAME

BACKGROUND OF THE INVENTION

1. Field of the Invention

The present invention relates to an electrical resistor having a negative temperature coefficient for incremental resistance values, and in particular to a lead structure for such a resistor and a method for the manufacture thereof.

2. Description of the Prior Art

Electrical resistors are known in the art having a negative temperature coefficient for incremental resistance values, generally referred to as a hot carrier, and NTC resistor or an NTC thermistor. Such resistors generally have a wafer of densely sintered metal oxide ceramic having a small diameter, such as in the range of 1.5 mm through 5 mm, and a low thickness, such as 0.6 mm through 2.5 mm. Firmly adhering and solderable coatings are applied to the opposite major faces of the wafer, and current lead elements are secured thereto with solder.

Wafer NTC resistors for temperatures from −60° C. through +300° C., preferably in the range of from −30°0 C. through +150° C. are manufactured, for example, from oxides of the transition metals manganese, iron, cobalt, copper, nickel and zinc by pressing under high pressure and subsequent sintering, as described in Siemens Heissleiter-Lieferprogramm 1984/85 July 1984 at page 2. The ceramic bodies which thereby result are not in a form capable of accepting soldered connections.

Electrical contacting for such a ceramic wafer is therefore generally undertaken by applying firming adhering metal coatings to the major opposite faces of the wafer. Such methods are well known in the art, as described in German OS No. 1 947 799, U.S. Pat. No. 3,676,211 and U.S. Pat. No. 3, 793,604.

When current lead elements are to be soldered to these coatings, the coatings are generally formed of two or more layers of different metals, of which the first layer, adjacent to the ceramic, consists of a metal which forms a firmly adhering ohmic contact with the ceramic material, to the extent such a contact is required, and the outer layer consist of an easily solderable, more precious metal.

For example, German OS No. 2 838 508 describes a method for solderable contact coating of ceramic PTC resistors free of a barrier layer wherein the first layer, consisting of aluminum or of an alloy predominantly containing aluminum, is produced in a silkscreen printing method, and the second layer, consisting of copper, is applied by a Schoop process.

Thermal sensors of preferably small wafer-shaped NTC resistor elements having solderable coatings and leads soldered thereto carrying the resistor element are manufactured in many forms, because an advantage of such a structure is the simply and inexpensive manner by which high numbers of such elements can be produced in an automatic manner.

The aforementioned U.S. Pat. No. 3,676,211 describes a method wherein a ceramic wafers provided with solderable coatings are clamped between crossed leads which are disposed parallel and radially on the electrode surface, the element with the leads being dip-soldered in an automated method and be subsequently provided with an insulating coating as needed.

The method described in U.S. Pat. No. 3,793,604 is also for manufacturing wafer thermistors, wherein the path on which the lead is soldered to the coating does not extend to the edge of the ceramic wafer, but rather extends only over half of the wafer diameter in the middle of the wafer. This structure is intended to effect an improved adhesion of the soldered leads.

When such thermistors having radially soldered leads are exposed to rapidly changing temperatures, thereby causing a temperature shock stress, the soldered connections are subjected to large mechanical loads resulting from the different thermal expansion properties of the ceramic and of the lead.

After repeated temperature shock stresses, the resistance drift of NTC resistor wafers having soldered current lead elements may amount to 100% of the initial resistance.

SUMMARY OF THE INVENTION

It is an object of the present invention to provide a small wafer-shaped NTC resistor having current lead elements soldered to solderable metal coatings on the wafer wherein the lead resistance has a drift of less than 1% given a temperature shock stress of 100 fold cycling between −60° C. and +300° C., preferably through −30° C. through +100° C. with a stable adhesion of the current lead to the ceramic wafer is maintained.

It is a further object of the present invention to provide a method for manufacturing such an NTC resistor.

The above objects are inventively achieved in an NTC resistor, and method for manufacturing same, wherein the current lead elements are coiled at the end thereof to be attached to the wafer. The coiled lead end forms a closed annular eye having an outside diameter which amounts to at most 60% of the diameter of the coatings of the wafer. The annular eye of each current lead element is centrally soldered to the coatings. The solder surrounds the eye, however, the extension of the solder is limited to the region of the eye and the edge regions of the coatings are not covered with solder.

The wire used to form the current lead elements having a closed annular eye may, for example, be silver wire, silver plated cooper wire, or tin plated copper wire. The wire cross-section preferably is in the range of between about 0.2 mm and 0.8 mm, depending upon the size of the NTC resistor wafer.

In a further embodiment of the invention, the current lead elements may be formed parts which are punched from a sheet of solderable metal having a material thickness of from between about 0.2 mm to about 0.8 mm, and wherein the difference between the outside diameter and the inside diameter of the eye at one end amounts to roughly twice the thickness of the sheet metal.

By fashioning one end of each current lead element as a closed annular eye having an outside diameter which is smaller than the wafer diameter, at least two advantages are achieved. First, a firmly adhering connection of the ceramic wafer to the ceramic lead elements is achieved having a peel strength of 15 N through 25 N, preferably 20 N.

Moreover, a surprising an unanticipated result is achieved by limiting the solder to the region of the annular eye and maintaining the edge regions of the coatings free of solder, this result being that the ceramic wafer exhibits a drift of less than 1% of its initial value, even after the occurrence of one hundred fold thermal cycling from −30° C. to +130° C.

The structure described above permits manufacture of small wafer NTC resistors which are stable against temperature shock stressing and which, in the cited temperature range, represent a cost-favorable alternative to conventional standard shock resistances NTC thermistors wherein, for example, platinum wires are directly sintered to the ceramic material, or small NTC resistor wafers having metalized end faces held in clamping contact springs for providing the electrical contact to the coatings.

Frequently, such thermistors are fused in a glass housing and are significantly more expensive to manufacture than comparable NTC resistors of the type described herein.

The use of a lead element in the form of an annular eye centrally soldered to a metallic coating is described in U.S. Pat. No. 2,606,955, however, this patent describes such a lead connection for a capacitor comprised of a ceramic wafer with metal surface coatings. The end of the current lead element, which is a wire, which is attached to the wafer is shaped into an eye which is not completely closed. Such formed wire ends are secured to the coatings by a dip soldering method, and are thus, completely covered with solder, even at the edge regions of the wafer.

It is noted in the aforementioned U.S. Pat. No. 3,793,604 that the peal strength of straight leads which are radially soldered to metallic coatings of wafer-shaped ceramic resistors can be noticibly increased if the lead is not attached to the edge region of the coatings, but is only soldered at the center of the wafer. The method described in this patent, however, also uses a dip soldering technique, so that the faces of the wafer to which the leads are attached are completely covered with solder, so that no significant improvement in the stability, given temperature shock stressing, results.

In accordance with the above discovery that resistance drift is substantially reduced by not covering the entire wafer face with solder, the method for manufacturing an NTC resistor described herein includes the step of soldering the current lead element in the form of a closed annular eye to the wafer with a quantity of solder selected such that the spread or extension of the molten solder is essentially restricted to only the region of the eye.

The principles of a known solder metering method, which is used for a completely different purpose, may be employed for selectively dimensioning the solder quantities necessary to manufacture the structure disclosed herein. Such a solder metering method is described in German patent No. 2 834 348 wherein a precisely selected quantity of a melt of a low-melting point metal is supplied to a compressed air nozzle, and is ejected from the nozzle onto the lead completely and is sprayed onto an area of a metal layer in the region of the lead, this area being defined by a lateral seal.

In accordance with the principles of the present invention, it is preferably, when solder in the form of a solder wire is brought into connection with the coatings in the middle of the wafer, that the solder spread radially when the solder location is heated, thereby essentially covering the region of the annular eye disposed on the wafer coatings.

DESCRIPTION OF THE PREFERRED EMBODIMENTS

Figure 1:
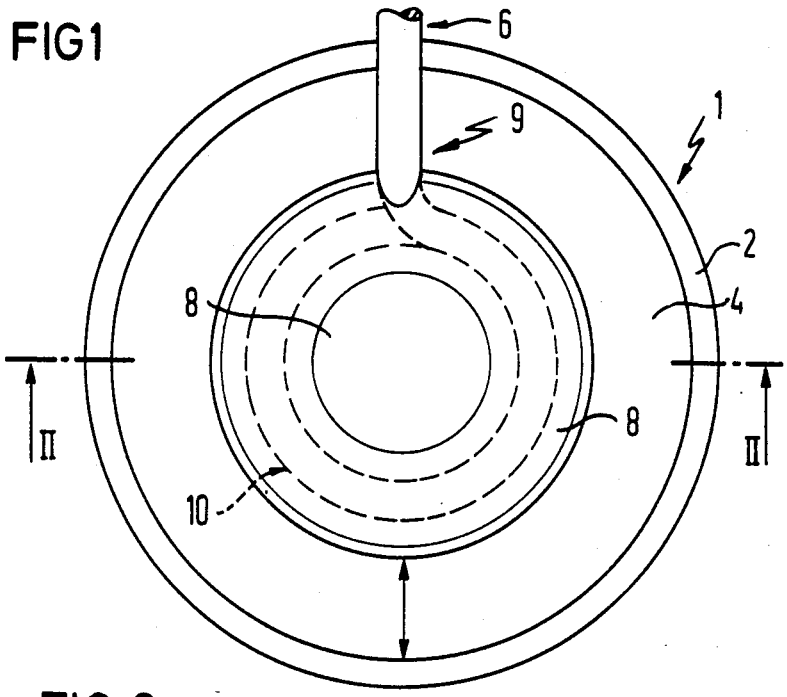
FIG. 1 is a plane view of a major face of an NTC resistor constructed in accordance with principles of the present invention.
Figure 2:
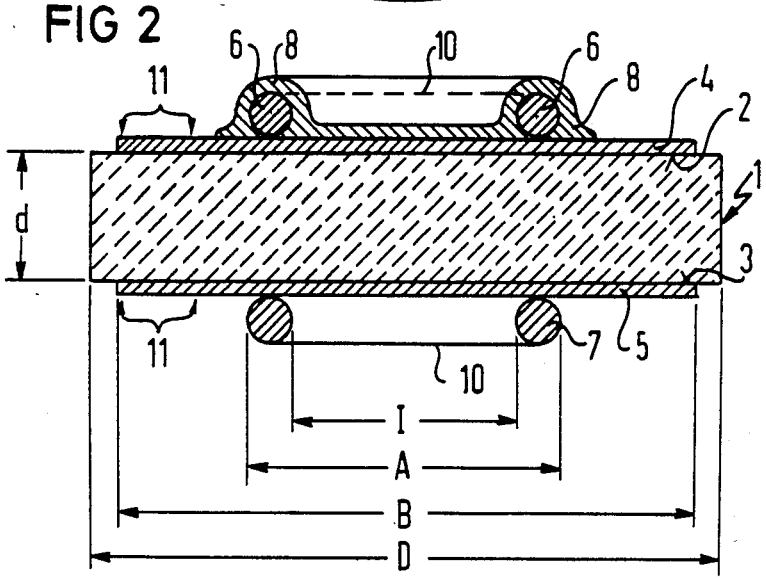
FIG. 2 is a side sectional view of the NTC resistor shwon in FIG. 1 taken along line II—II.

An NTC resistor constructed in accordance with the principles of the present invention it is shown in two views in FIG. 1 and FIG. 2. The resistor includes a wafer 1 of resistance material having a diameter D of approximately 3 mm and a thickness d of approximately 1 mm. The wafer 1 may consist, for example, of densely sintered metal oxide ceramic, and has a negative temperature coefficient for incremental resistance values. The wafer 1 has opposite major faces 2 and 3, being respectively provided with metal coatings 4 and 5.

The coatings 4 and 5, which adhere firmly to the wafer 1 and are free of any barrier layer may consist, for example, of a first layer of aluminum or of an alloy predominantly containing alluminum produced by a silkscreen printing method and a second solderable layer of copper applied by a schoop process.

It may also be sufficient, however, depending upon the type of oxide ceramic employed, to directly apply the coatings 4 and 5 to the faces 2 and of the wafer 1 by the use of stoving silver as described, for example, in the aforementioned U.S. Pat. No. 3,793,604.

The coatings 4 and 5 did not extend entirely to the edges of the wafer 1, but may instead havine a diameter B which is less than the diameter D.

The lead elements 6 and 7 each have an end 0 to be attached to the respective coatings 4 and 5 in the form of a closed annular eye 10. The eye 10 has an inside diameter I and an outside diameter A which may be, for example, 1.5 mm. The annular eyes 10 may be stamped in the form of a ring from sheet metal or, as indicated by the dashed lines in FIG. 1, consist of coiled wire. If wire is utilized, the wire is preferably silver wire having a diameter of 0.4 mm. If the lead elements are formed from sheet metal, the annular eye preferably has a difference between the outside diameter A and the inside diameter I which approximately twice the thickness of the sheet metal.

The eyes 10 are centrally disposed on the coatings 4 and 5 and are secured thereto with solder 8. The solder is applied in a quantity sufficient only to surround the eyes 10, and covers the coatings 4 and 5 essentially only in the region of the eyes 10. The edge regions 11 of the coatings 4 and 5 remain free of the solder 8. In FIG. 2, the solder 8 has been shown applied only at the face 2 for better illustrating the eye 10. The solder 8 is applied so that the diameter of the resulting hardened solder, which may be assumed to be substantially coextensive with the diameter A, is at most 60% of the diameter B of the coatings 4 and 5.

Although modifications and changes may be suggested by those skilled in the art it is the intention of the inventor to embody within the patent warranted hereon all changes and modificatons as reasonably and properly come within the scope of their contribution to the art.

I claim as my invention:

1. An NTC resistor comprising:

a wafer consisting of densely sintered metal oxide ceramic having a diameter in the range of from about 1.5 mm through about 5.0 mm, a thickness in the range of from about 0.6 mm through about 2.5 mm, and having two opposite major faces;

solderable metal coatings respectively substantially covering and adhering to said major faces; and two current lead elements respectively secured to each metal coating with solder, each lead element having a closed annular eye centrally disposed on said major face adjacent said coating, said annulus eye having a diameter which is less than about 60% of the diameter which of said coating and said solder being substantially coextensive with said annulus eye leaving a solder-free edge of said coating.

2. An NTC resistor as claimed in claim 1, wherein said lead elements consist of solderable wire having a diameter in the range of from about 0.2 mm through about 0.8 mm and having an end coiled to form said closed annular eye.

3. An NTC resistor as claimed in claim 1, wherein said current lead elements are sheet metal having a thickness in the range of from about 0.2 mm through about 0.8 mm stampted to form said closed annular eye, said annular eye having an outside diameter and an inside diameter and the difference between said outside and inside diameters being approximately twice the thickness of said sheet metal.

4. A method for manufacturing an NTC resistor comprising:

covering opposite major faces of a wafer consisting of densely sintered metal oxide ceramic with solderable metal coatings, said metal coatings having a diameter;

forming two current lead elements each having a closed annular eye having a diameter which is less than about 60% of the diameter of said coating; and soldering said current lead elements respectively to said metal coatings with said annular eye centrally disposed on each major face and adjacent to said coating, said solder being applied substantially coextensively with said annular eye leaving a solder-free edge region of said coating.

5. A method for manufacturing an NTC resistor as claimed in claim 4, wherein the step of applying said solder is further defined by the steps of:

bringing a solder wire into connection with said coatings in a center of said wafer; and radially spreading the molten solder as said solder location is heated thereby covering substantially only the region of said annular eye on said coating.

* * * * *